United States Patent [19]

Hiramatsu et al.

[11] Patent Number: 4,648,335

[45] Date of Patent: Mar. 10, 1987

[54] APPARATUS FOR SETTING A WORKPIECE CORRECTLY ON A SEWING MACHINE

[75] Inventors: Tooru Hiramatsu; Kazuya Tami; Kozo Osawa, all of Chofu, Japan

[73] Assignee: Tokyo Juki Industrial Co., Ltd., Chofu, Japan

[21] Appl. No.: 856,692

[22] Filed: Apr. 28, 1986

[30] Foreign Application Priority Data

Apr. 27, 1985 [JP] Japan ..... 60-91720

[51] Int. Cl.[4] ..... D05B 3/12

[52] U.S. Cl. ..... 112/114

[58] Field of Search ..... 112/114, 104, 70, 74, 112/76, 121.26, 121.27

[56] References Cited

U.S. PATENT DOCUMENTS

| | | | |
|---|---|---|---|
| 2,025,598 | 12/1935 | Levin | 112/114 |
| 2,410,399 | 10/1946 | Wood | 112/114 |
| 3,669,043 | 6/1972 | Nicolay | 112/114 X |
| 3,777,684 | 12/1973 | Friedman et al. | 112/121.27 X |
| 4,109,591 | 8/1978 | Rakacs | 112/76 |
| 4,594,953 | 6/1986 | Ando et al. | 112/114 X |

*Primary Examiner*—H. Hampton Hunter

*Attorney, Agent, or Firm*—Morgan & Finnegan

[57] ABSTRACT

An apparatus for setting a zipper and a front cloth to sew in correct position providing a pair of set-plates which perform three dimensional motion: vertical swing to clamp a workpiece and horizontal swing to form a "V" shape to receive a slitted front cloth and forming parallel lines to locate the zipper and the front cloth in the correct position. The motion of the set-plates is driven by air cylinders actuated by a pedal switch.

1 Claim, 23 Drawing Figures

APPARATUS FOR SETTING A WORKPIECE CORRECTLY ON A SEWING MACHINE

BACKGROUND OF THE INVENTION

This invention relates to a sewing machine specially designed to stitch a zipper to fabrics and more particularly to an apparatus for positioning a zipper in correct position.

When a zipper is to be stitched to the fabric of a skirt, the zipper is first stitched to a fabric lining cloth and then this lining fabric and a front cloth material are sewed together. During this process, the positioning of the lining cloth and the front cloth material is very important since this positioning influences the final grading of stitch work. Therefore, the positioning work requires precision work and several manufacturing steps. To avoid such precision work and manufacturing steps, many kinds of automatic zipper sewing machines have been developed.

FIG. 14 and FIG. 15 illustrate how the conventional zipper sewing machine works when the zipper is being sewed to the skirt. Referring to FIG. 14 and FIG. 15, "a" denotes a sewing machine, "k" denotes a lining cloth with a zipper "l" previously sewed therewith, "j" denotes a front cloth, "$j_1$" denotes a sewed portion of the front cloth, and the numeral 30 denotes a casset-set.

At first, the casset-set is placed on a table "m". The lining cloth k with the zipper l previously sewed therewith and the front cloth j are set on the casset-set 30 manually. After clamping the fabric with the casset-set 30, the casset-set is placed on a feeding table "g" of a sewing machine a. An air cylinder "b" is installed on the feed table g and air is supplied to plunger side of the cylinder. The plunger is drawn, and resultantly, a pair of foot presses "i" the casset-set 30 through linkage motion via a shaft "f", a lever "d", and a pressing arm "e". The sewing machine a is then driven by an automatic X-Y coordinate driver (not shown) in direction of X and Y accordingly, and thus the front cloth and the lining cloth k are sewed together.

According to conventional procedures, the front cloth j and the lining cloth k are set manually relying on the human eye. Thus, it is difficult to secure correct positioning and time is wasted in the process. In some cases, the zipper is not symmetrically positioned relative to the center line and therefore the distances p, q (refer to FIG. 16*a*) are not equal. When the difference is beyond a certain degree, the needle strikes the stopper $l_1$ of zipper l and the needle is often broken.

Referring to FIG. 16*b*, if the position of the already sewed portion Sr does not coincide with the position of center line of the zipper, the portion z as shown in FIG. 16*b* is wrinkled.

SUMMARY OF THE INVENTION

With the foregoing in mind, it is an object of the invention to provide an apparatus for rapidly setting a front cloth and a lining cloth in the correct position when a zipper is to be sewed and thereby saving time spent over conventional positioning work by application of the apparatus.

According to this invention, a pair of parallel positioned setting plates are pivoted at one end so that the other end of the setting plates move up and down and the setting plates may be narrowed into a "V" shape formation. Thus, the apparatus is adapted to perform three dimensional action (move up, move down, narrow) and such action is effective to achieve the purpose of this invention.

BRIEF DESCRIPTION OF THE DRAWINGS

The accompanying drawings, referred to herein and constituting a part hereof, illustrate a preferred embodiment of the invention and, together with the description, serve to explain the principles of the invention, wherein.

DETAILED DESCRIPTION OF THE DRAWINGS

Figures 1, 1A:
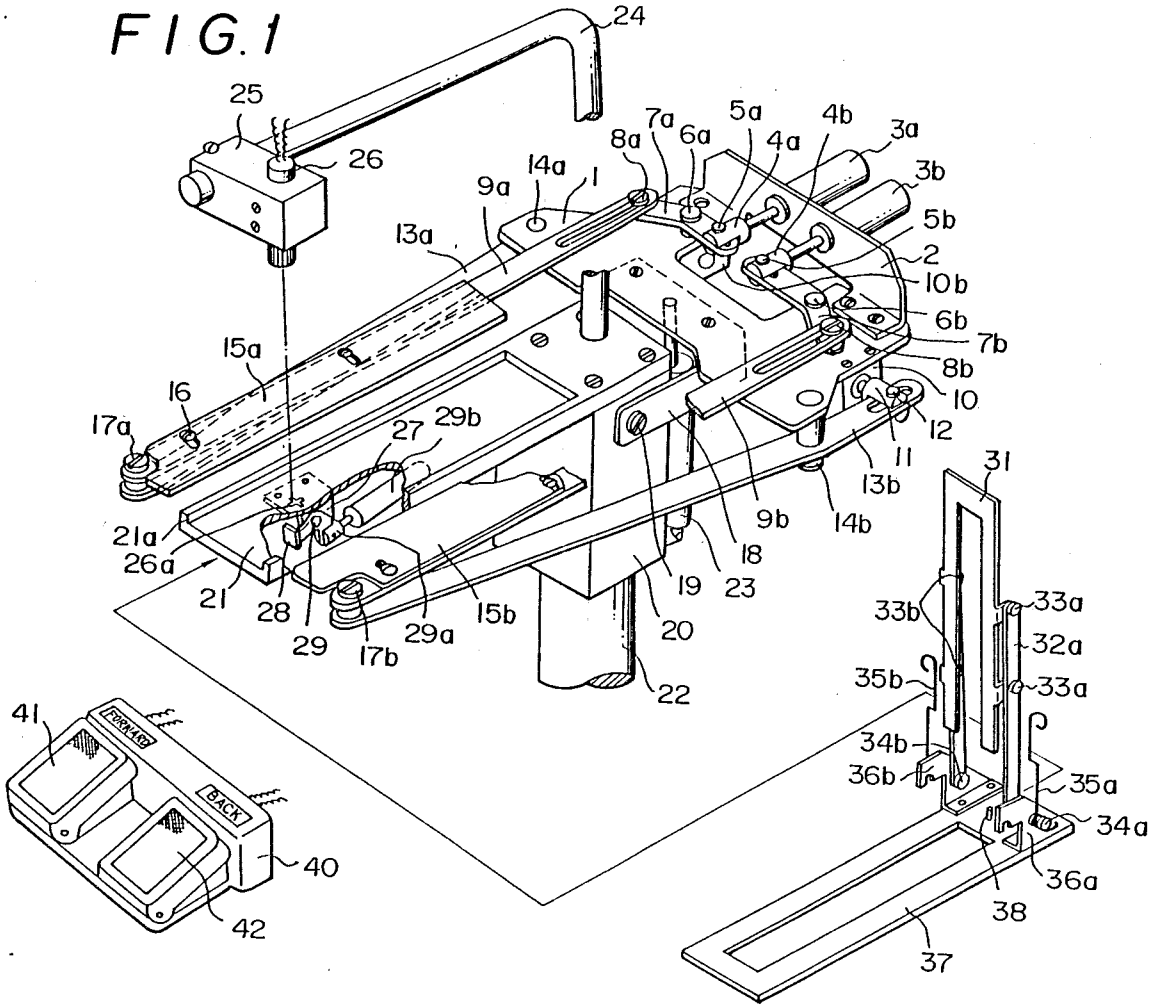
FIG. 1 is a perspective view of one embodiment of this invention.
FIG. 1*a* is a perspective view of a pedal switch used in the embodiment of FIG. 1.

Referring to the accompanying drawings, one prefered embodiment of this invention will be explained hereinafter. FIG. 1 is a perspective view of a preferred embodiment of the material setting apparatus according to this invention, showing essential parts therein. Some portions are shown in partially cut section views.

At first, construction of this preferred embodiment will be explained. A casset table 21 is fixed on a table 20 located on top of a support column 22 standing on a base (not shown). A pair of set-hinges 18 are placed facing around the table 20 and are pivoted on a shaft 19. At the other end of the set-hinges 18, an install-plate 1 is provided. A pair of link levers 7*a*, 7*b* are positioned symmetrically about the center line of the install-plate 1 and each is pivoted on pins 6*a*, 6*b* respectively. The inner ends of link levers 7*a*, 7*b* are pivoted on shafts 5*a*, 5*b*, respectively, and are connected to plungers 4*a*, 4*b* of air cylinders 3*a*, 3*b* respectively. The outer ends of link levers 7*a*, 7*b* are pivoted to shafts 8*a*, 8*b* and these shafts 8*a*, 8*b* slidably pass through oblong holes provided at link lever 9*a*, 9*b*. The cylinders 3*a*, 3*b* are fixed to a cylinder support 2 which in turn is fixed to the install plate 1.

On each link lever 9*a*, 9*b*, set-plates 15*a*, 15*b* are fixed by screws 16 and thus the set-plates 15*a*, 15*b* are positioned in parallel. The other end of link levers 9*a*, 9*b* are pivoted on shafts 17*a*, 17*b* which connect rotatably the link levers 9*a*, 9*b* to the end of set-levers 13*a*, 13*b*. The other end of set-levers 13*a*, 13*b* are pivoted on shafts 12 which are connected to a set-cylinder 10*a* (not shown) and 10*b*, respectively, via plungers 11*a* (not shown) and 11*b* respectively. The middle portion of set levers 13*a*, 13*b* are pivoted on shafts 14*a*, 14*b* which connect to the install-plate 1. (Thus the set-levers 13*a*, 13*b* are pivoted on each side of the install-plate 1)

On the casset table 21, a channel 21*a* is provided to install the casset-set 30, and at the back-side of the casset table 21 a bearing 27 is provided to support a hinge 29 and a lining cloth presser 28 is pivoted on the bearing 27. One end of the cloth presser 28 is connected to a plunger 29*a* of the cylinder 29*b* which presses the lining cloth. A mark light pole 24 is provided at upper side of the casset table 21. At the end of the horizontally extending pole 24, a mark light 26 is provided, and this mark light 26 projects a spot mark 26*a* on the casset table 21.

In the casset-set 30, a presser plate 31 is sustained by a pair of material press levers (right, left) 32*a*, 32*b* by shafts 33*a*, 33*b* respectively. The lower end of the material press levers 32*a*, 32*b* are pivoted on shafts 34*a*, 34*b*. Numerals 35*a*, 35*b* denote springs which are hooked on semi-circular notches at lever holding plates 36*a*, 36*b*, and these springs press the front cloth j. Numeral 38 denotes a pin which will be inserted into a slider's hole to guide and position a zipper.

FIG. 1*a* shows a pedal switch 40 used for this embodiment and comprises a forward switch 41 and a backward switch 42.

Figure 2:
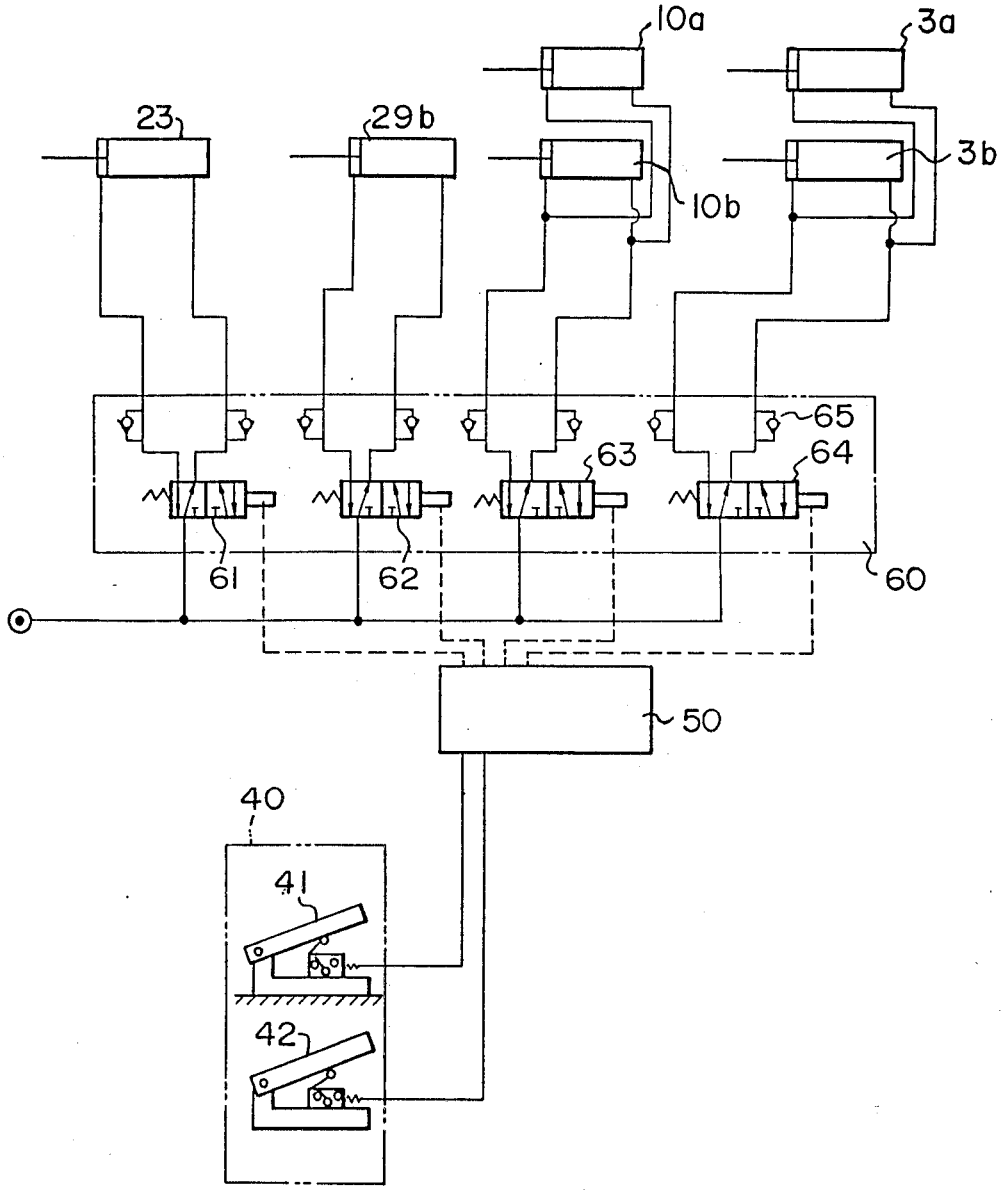
FIG. 2 is an air pressure circuit diagram according to the embodiment of FIG. 1.

FIG. 2 is an air pressure circuit diagram for FIG. 1. Numeral 50 denotes a controller, and the commands from the switches 41, 42 energize the pressing cylinder 23, the lining cloth pressing cylinder 20*b*, the setting cylinders 10*a*, 10*b* cylinders 3*a*, 3*b* in relation with the control of solenoid valves 61, 62, 63, 64, which control these cylinders, and these solenoid valves are assembled in a solenoid valve box 60.

Figure 3:
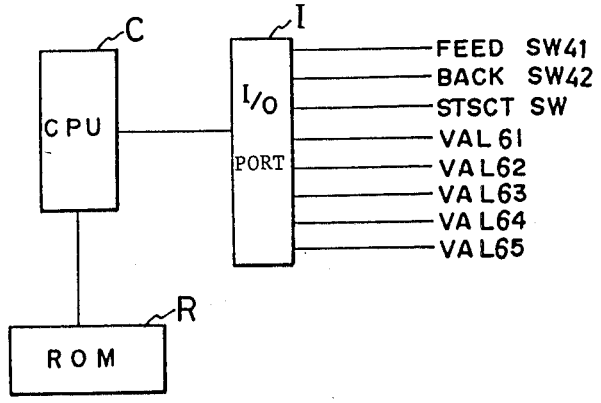
FIG. 3 is conceptual control block diagram according to the embodiment of FIG. 1.
Figure 4:
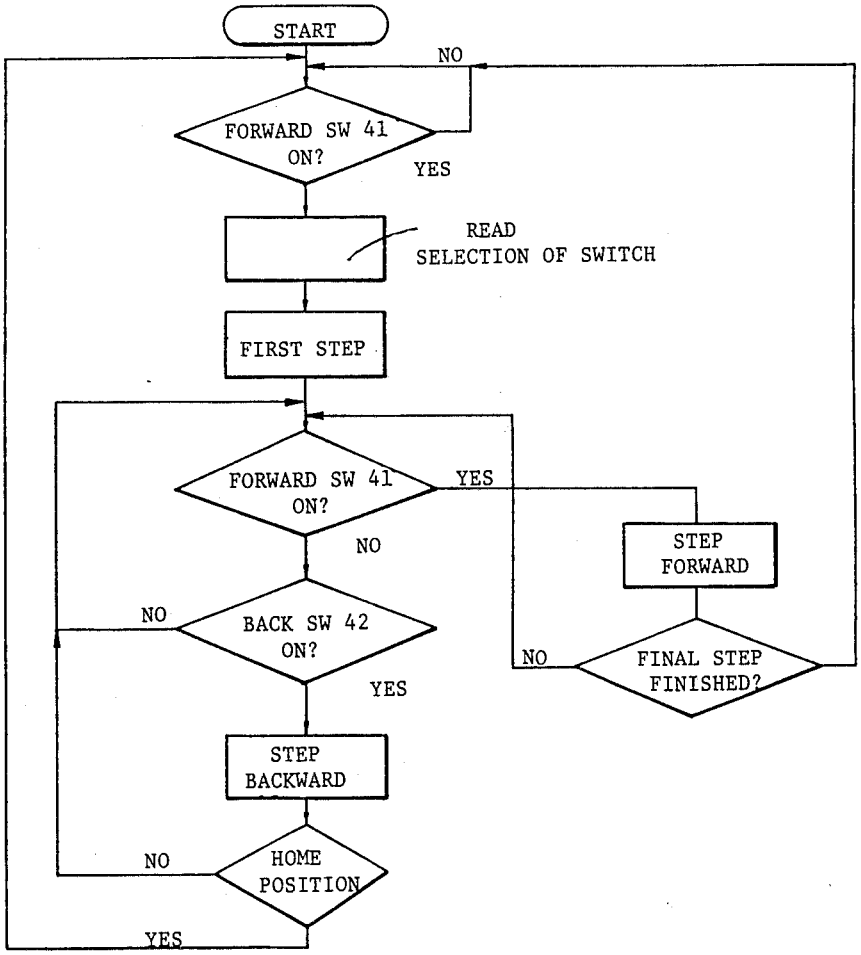
FIG. 4 is an operational flow diagram according to the embodiment of FIG. 1.

FIG. 3 shows a conceptional block diagram of controller 50. "C" denotes a CPU (central processing unit) and "R" denotes a ROM (read only memory) for sequential program. "I" denotes selective switches by the forward switch 41 and the backward switch 42 and also denotes input/output ports for solenoid valves 61, 62, 63, 64 and a speed control valve 65. FIG. 4 is a flow chart explaining operation of this embodiment.

FIGS. 5 through 13 explain the operation of this embodiment in detail based on the flow chart in FIG. 4. Forwarding and backwarding are performed by the pedal switch 40 as illustrated in FIG. 1*a* and FIG. 3. When the forward switch 41 is depressed, the work is advanced by one step, and when the backward switch 42 is depressed the work is backed up to one step before position.

Figure 5:
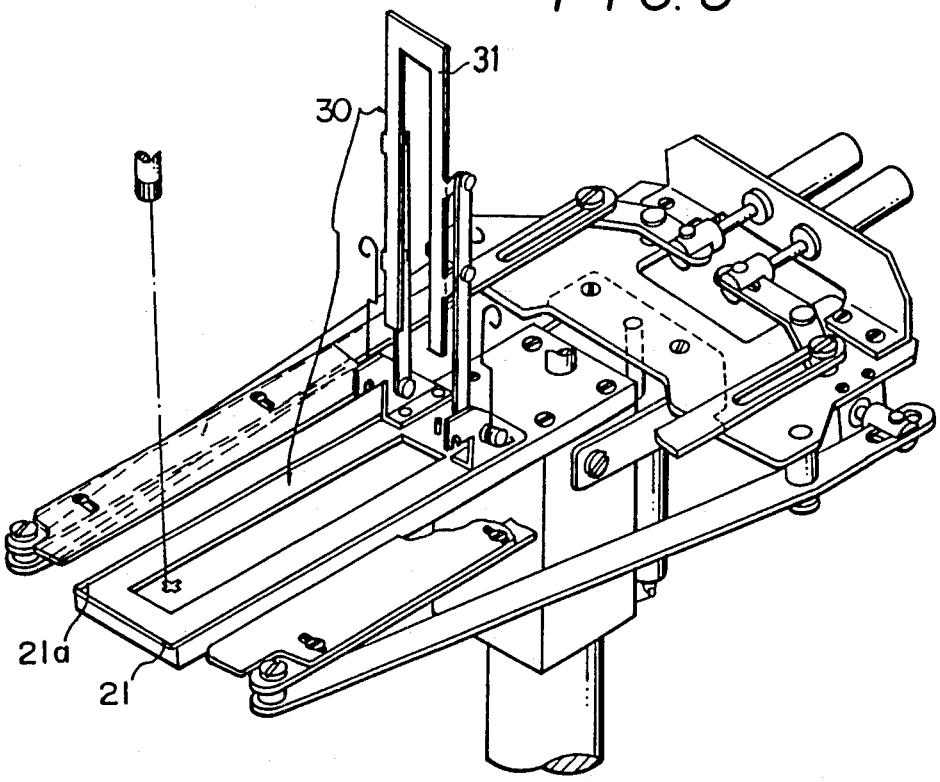
FIG. 5 through FIG. 13 illustrate various aspects in the operation of the invention.
Figure 6:
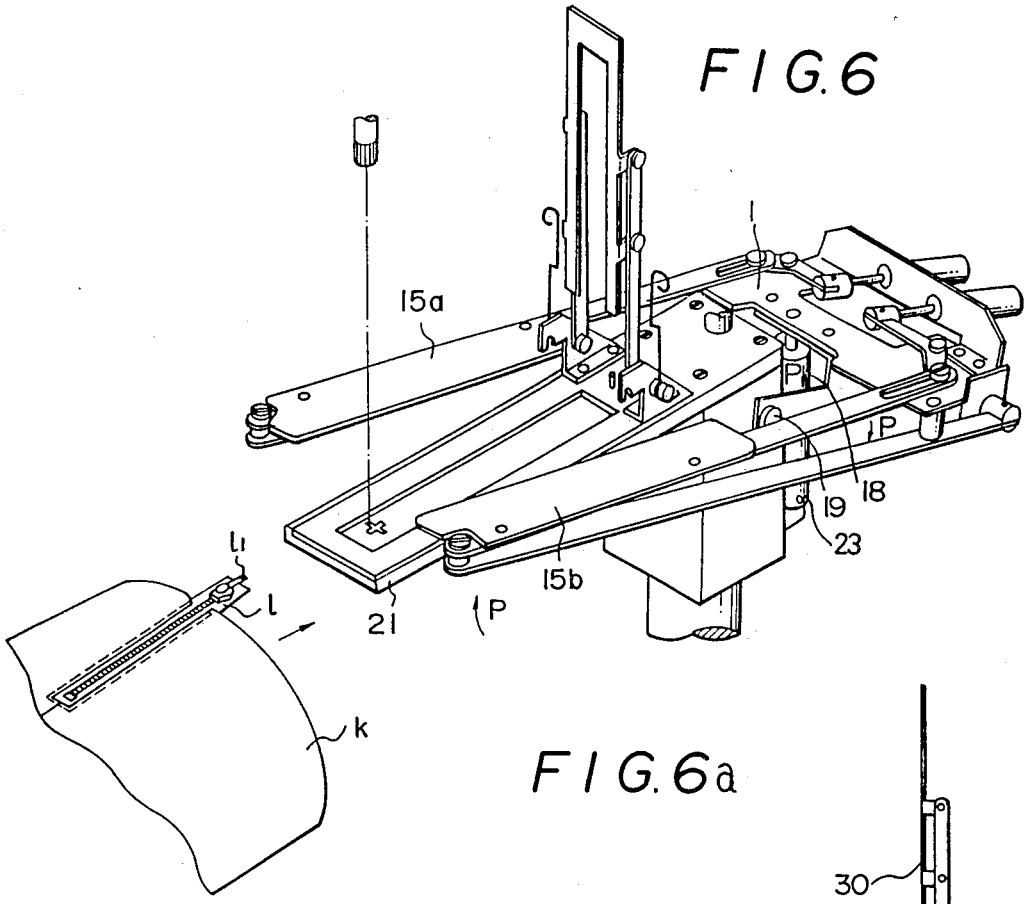
Figure 6A:
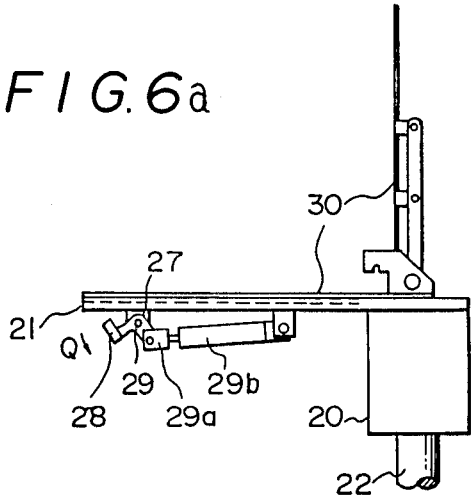

As the first step, referring to FIG. 5, casset-set 30 is inserted into the channel 21*a* of the casset table 21. At this time, the material pressing plate 31 is in an open condition, then following six steps are performed:

(1) FIRST STEP (refer to FIG. 6, FIG. 6*a*)

The forward switch 41 is pressed one time. Air flows into the rod side of the pushing cylinder 23, the rod draws, and the install-plate 1 moves in direction of arrow "P" keeping the shaft 19 as the center. A pair of set-plates 15*a*, 15*b* are raised and positioned as FIG. 6 shows. At this time, referring to FIG. 6*a* which shows under side of the casset table 21, air is supplied to the plunger side 29*a* of the lining cloth pressing cylinder 29*b*, and the plunger 29 is drawn, and the lining cloth pressing lever 28 is rotated in direction of arrow "Q" keeping the shaft 29 as the center.

Figure 7:
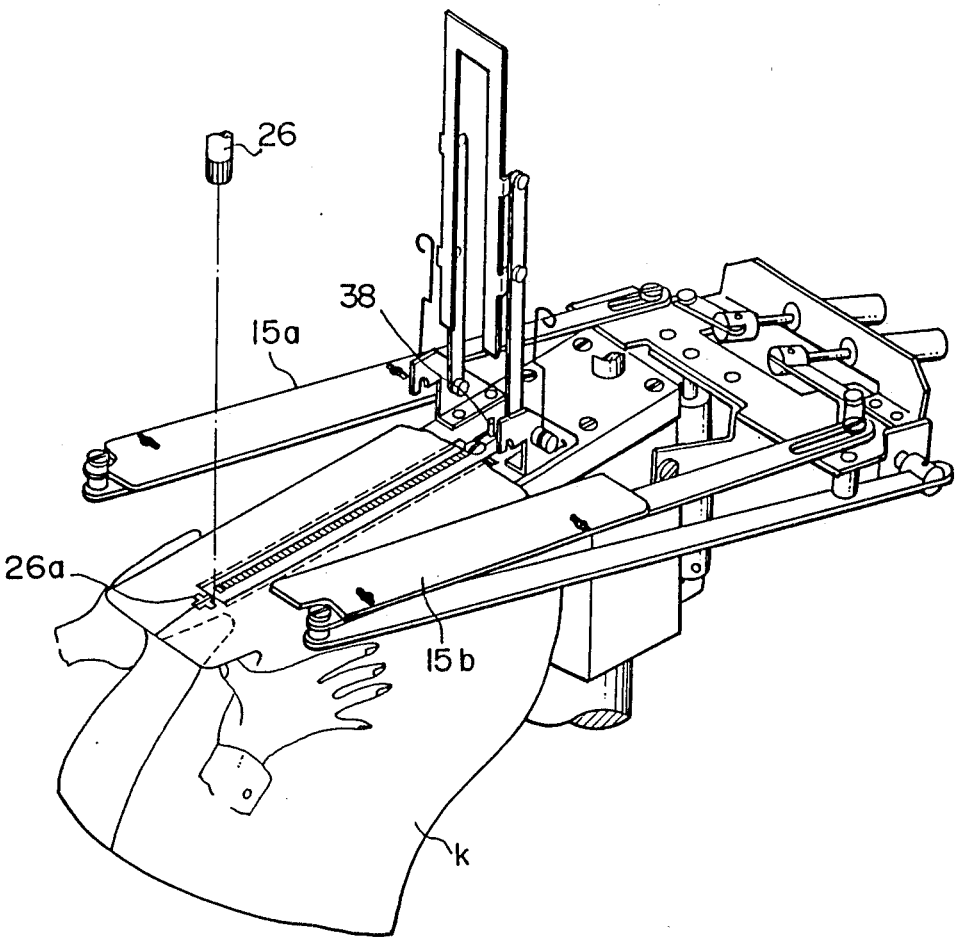
Figure 7A:
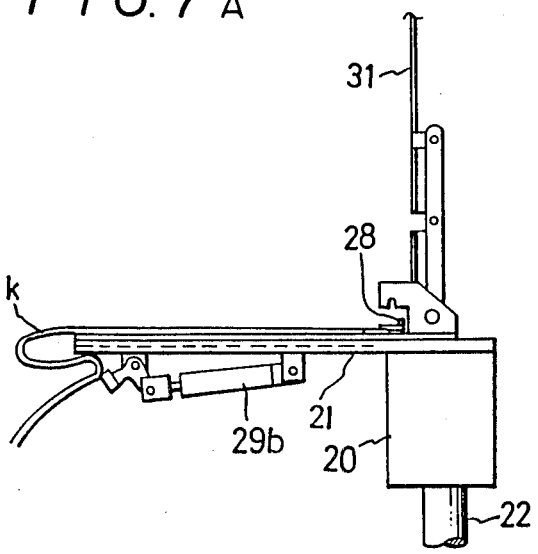
Figure 7B:
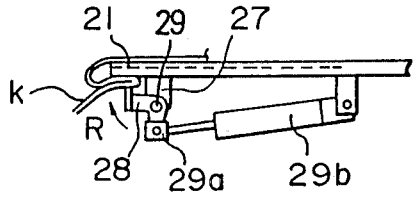

(2) SECOND STEP (refer to FIG. 7*a*, FIG. 7*b*)

A hole of zipper slider $l_1$, (refer to FIG. 6) is hooked to the pin 38. The lining cloth k is properly set on the casset table 21, so that the spot mark 26*a* from the mark light 26 positions at the center line of the zipper. Then, the forward switch 41 of pedal switch 40 (FIG. 1*a*) is pressed. Air is supplied to the counter-plunger side of the lining cloth pressing cylinder 29*b*, and the plunder 29*a* extends, and the lining cloth pressing lever 28 rotates in direction of arrow "R" (FIG. 7*b*) keeping the shaft 29 as the center. Thus, the lining cloth k is clamped between the back side of the casset table 21 and the lining cloth pressing lever 28.

Figure 8:
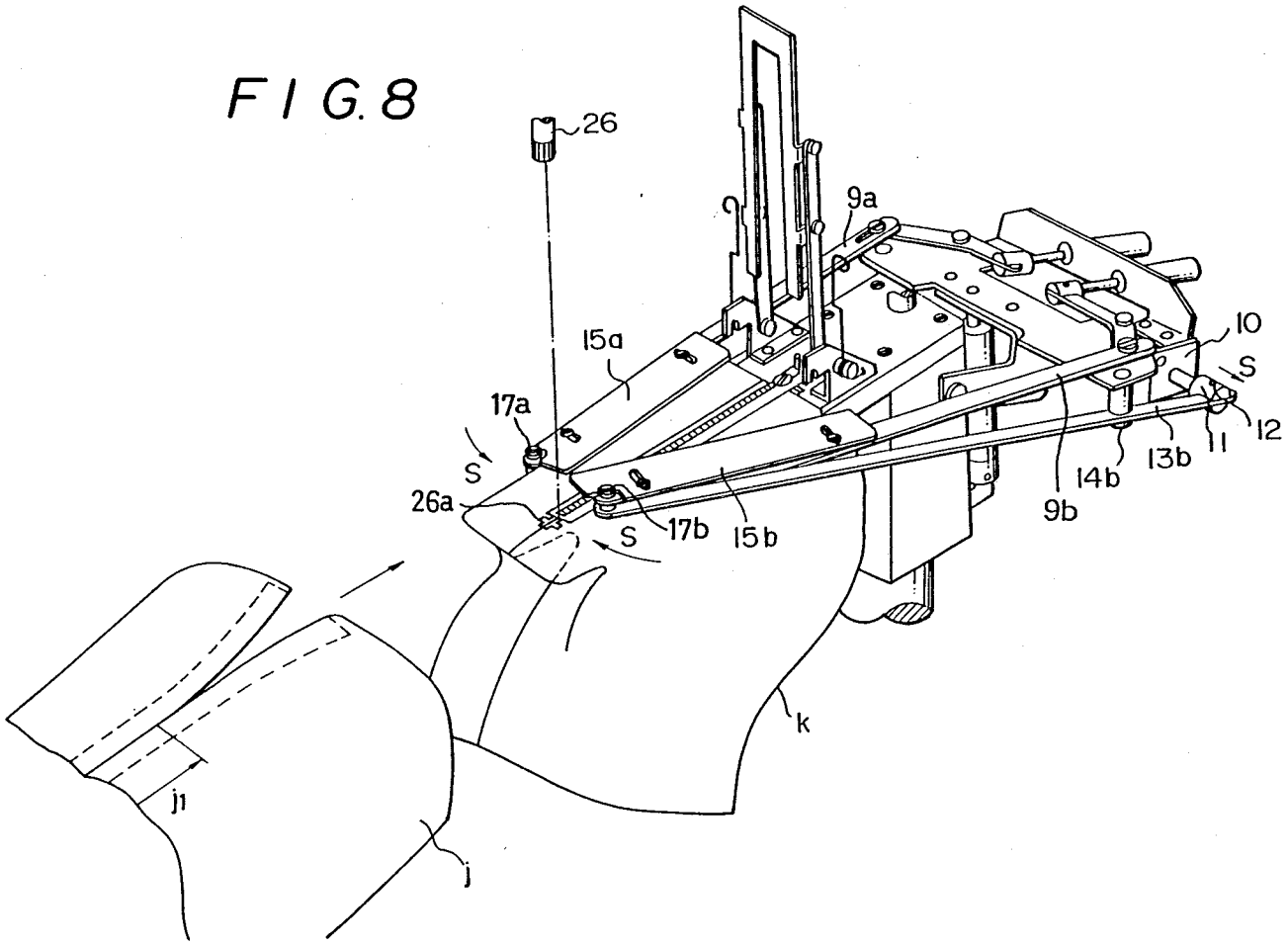
Figure 9:
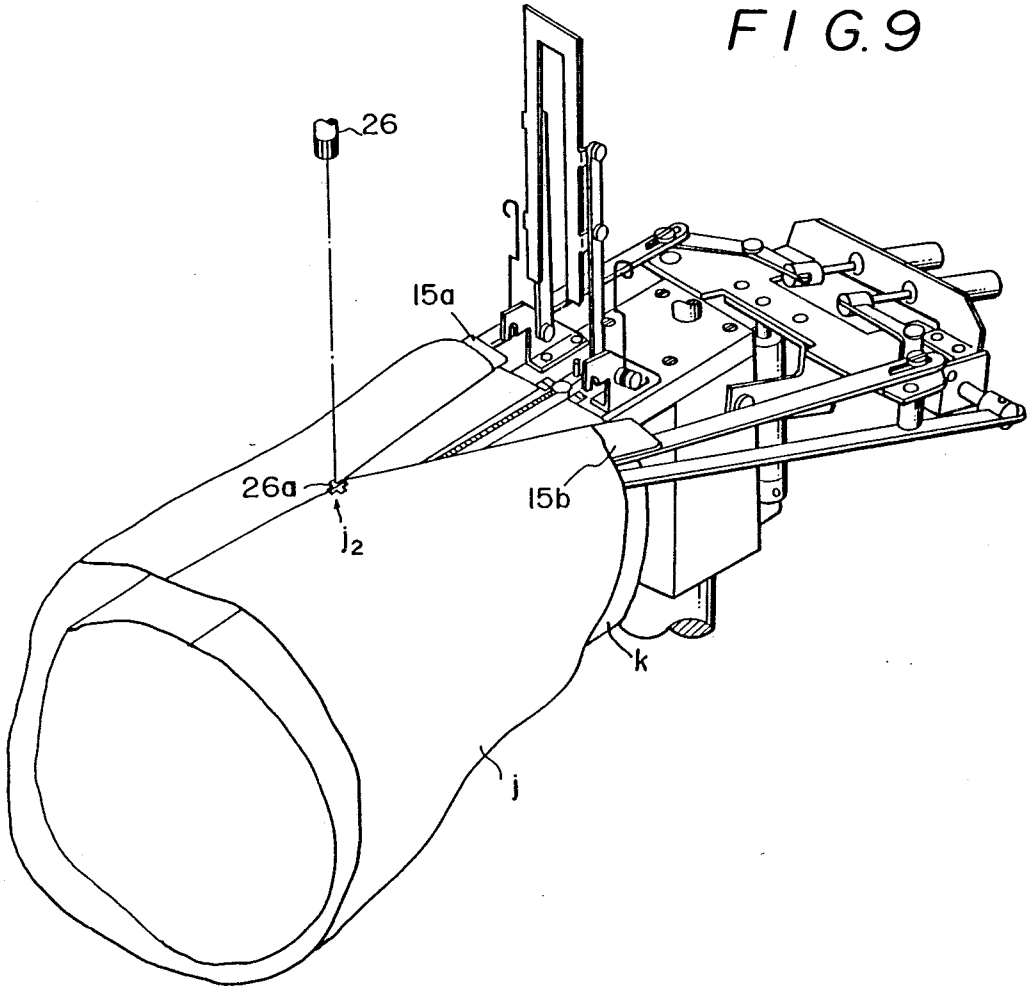

(3) THIRD STEP (refer to FIG. 8, FIG. 9)

The forward switch 41 is further pressed. Air is supplied to the counter-plunger side of the setting cylinder 10, and the plunger extends, and the set-lever 13*b* rotates in the direction of arrow "S" (FIG. 8) keeping shaft 14*b* as the center. (Although the other set-lever 13*a* is not shown, it moves as set-lever 13*b*).

The link levers 9*a*, 9*b* are moved in direction of "S" via the shafts 17*a*, 17*b*. Accordingly, the set-plates 15*a*, 15*b* move in direction of "S", respectively, and finally the set plates 15*a*, 15*b* form a "V" shape. Then, referring to FIG. 9 the front cloth j is placed on the "V" shaped set plates 15*a*, 15*b*, and a junction point $j_2$ is indicated with the spot mark 26*a*.

Figure 10:
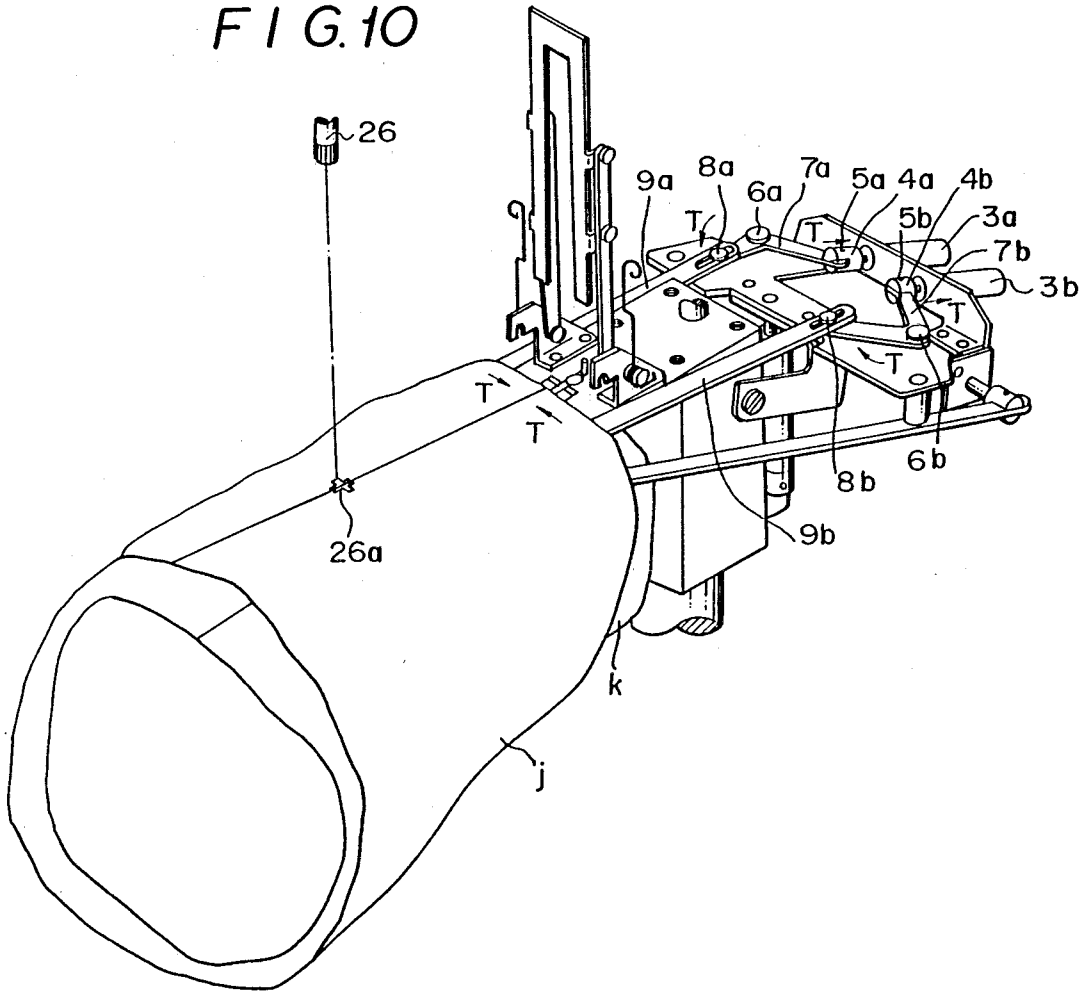

(4) FOURTH STEP (refer to FIG. 10)

The forward switch 41 is further pressed. Air is supplied to the plunger side of the cylinders 3*a*, 3*b* and plungers 4*a*, 4*b* are drawn. The link levers 7*a*, 7*b* rotate the set-plates 15*a*, 15*b* in the direction of arrow "T" respectively via the shafts 5*a*, 5*b*, 8*a*, 8*b*, and the link levers 9*a*, 9*b*. The "V" shaped set-plates 15*a*, 15*b* (explained at Step 3) move to narrow the angle of the "V".

Figure 11:
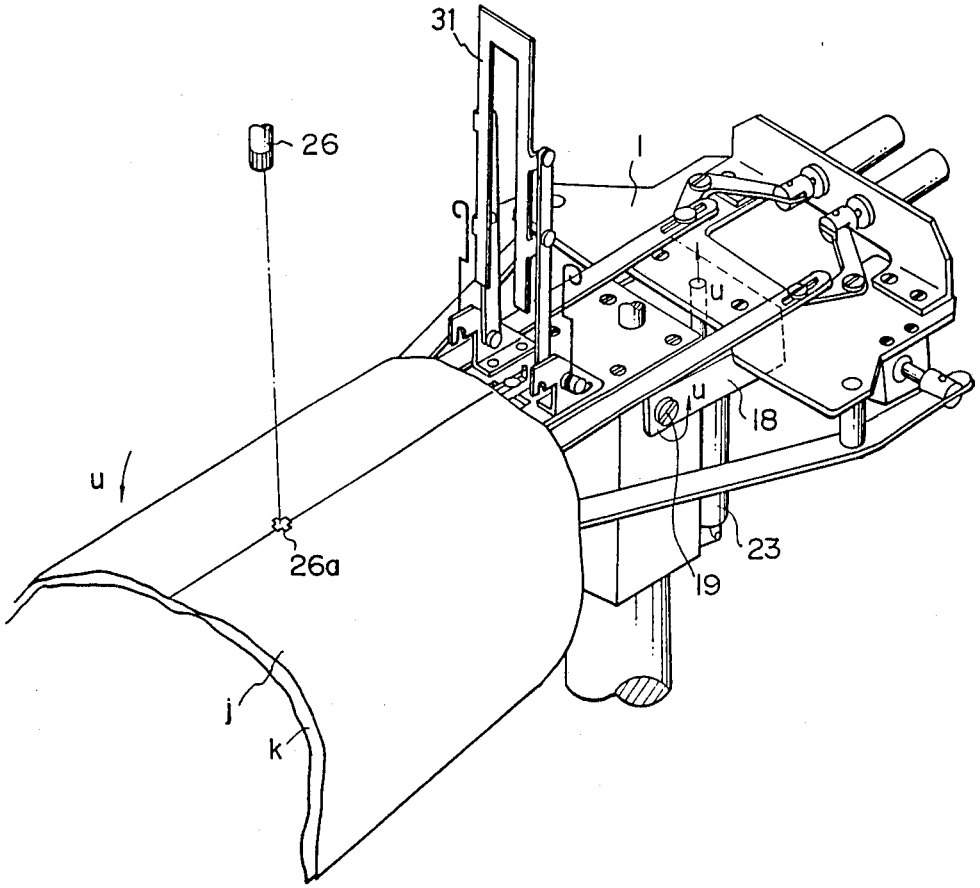

(5) FIFTH STEP (refer to FIG. 11)

The forward switch 41 is further pressed by one step. Air is supplied to the counter-plunger side of the pressing cylinder 23, the plunger extends, and the install-plate 1 turns in direction of "U" (FIG. 11) via the hinge 18 keeping the shaft 19 as center. The front cloth j is pressed to the lining cloth k by the set-plates 15*a*, 15*b*.

Figure 12:
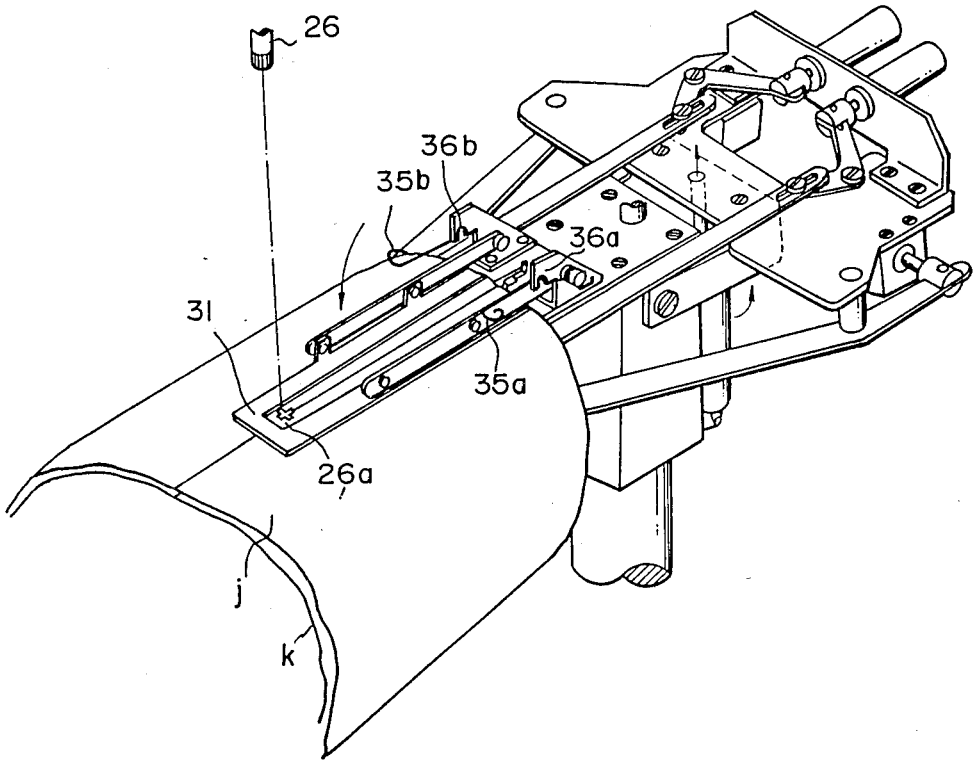
Figure 13:
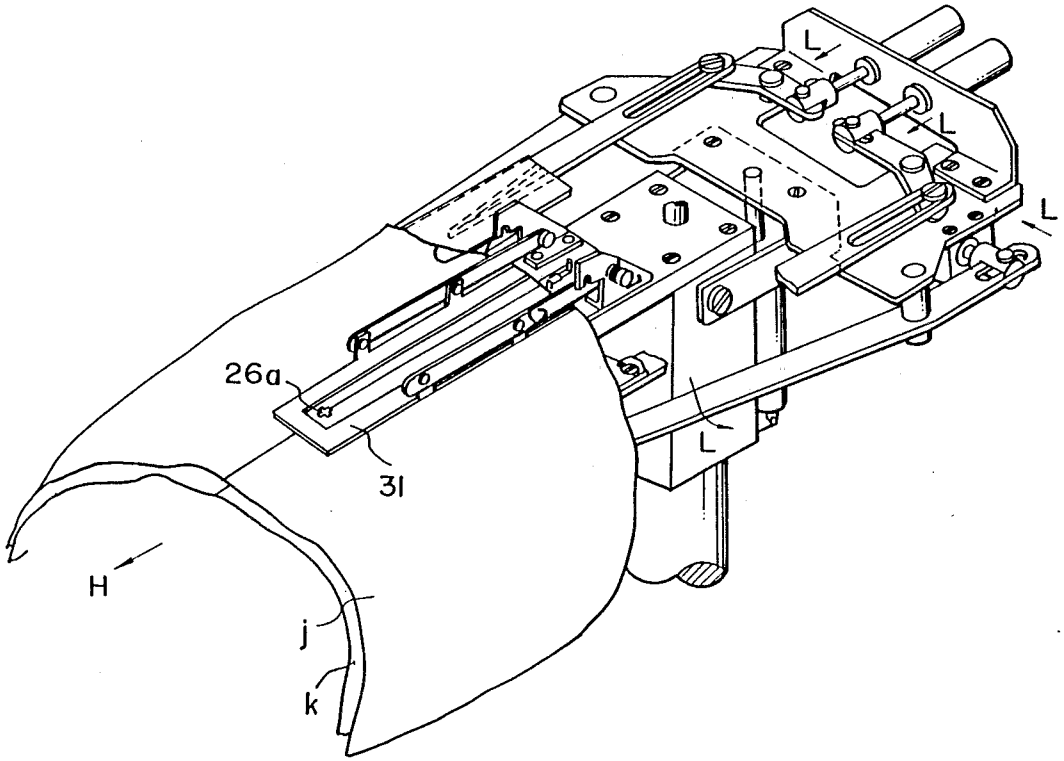
Figure 14:
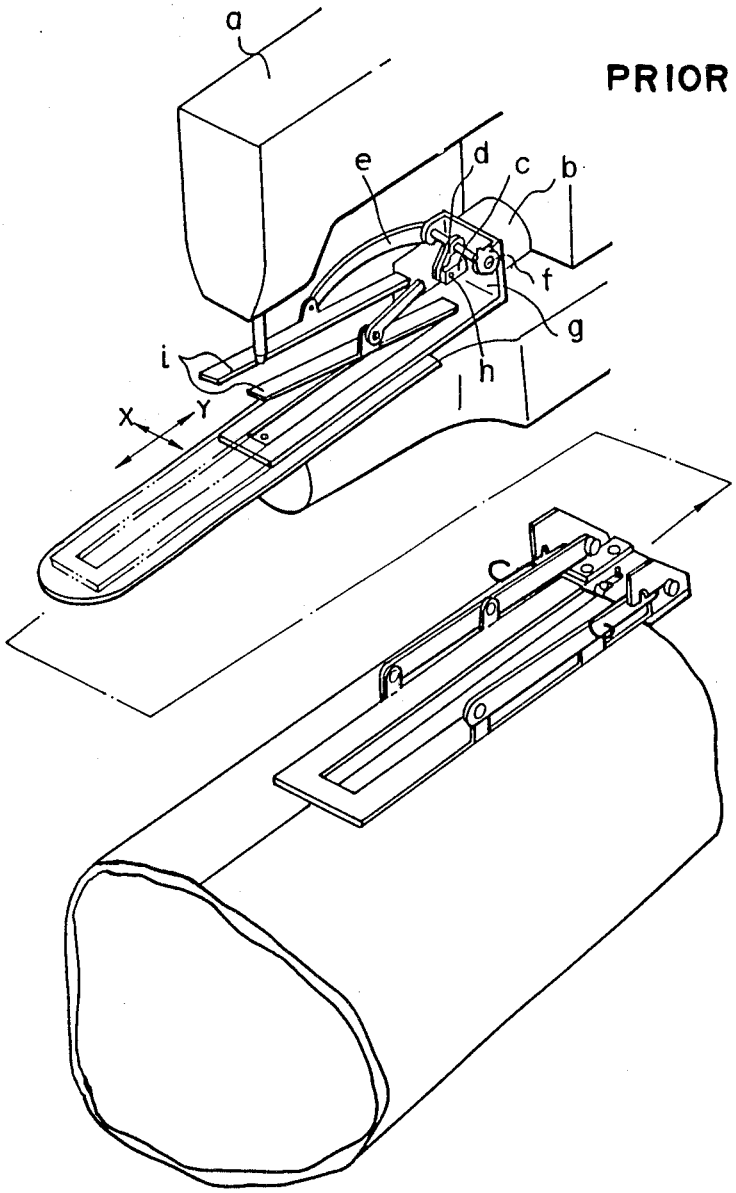
FIG. 14 PRIOR ART
FIG. 14 and FIG. 15 show conventional procedures for setting a workpiece to sew a zipper to the workpiece.
Figure 15:
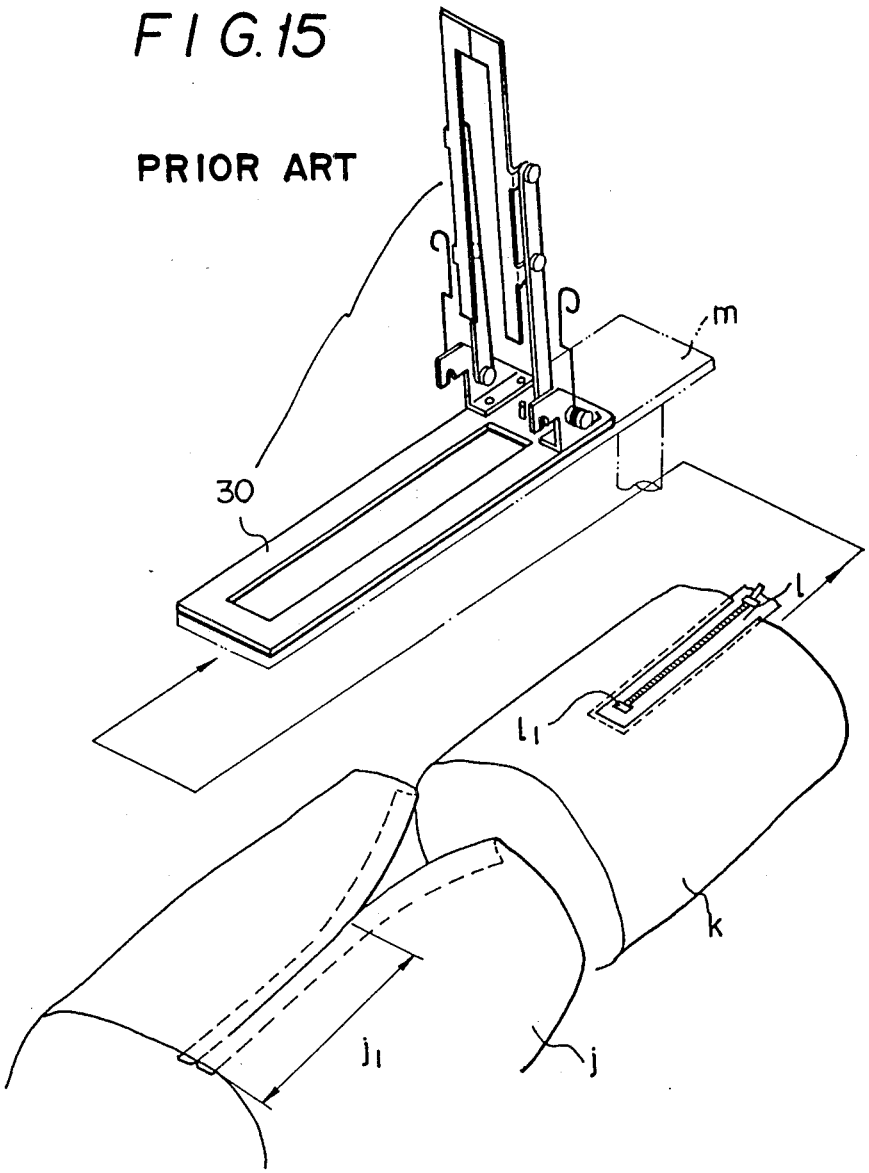
FIG. 15 PRIOR ART
Figure 16A:
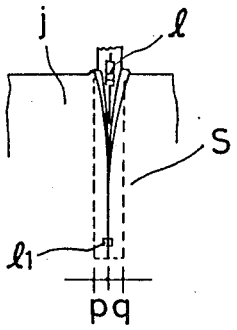
FIG. 16A and FIG. 16B illustrate conventional problematic points.
Figure 16B:
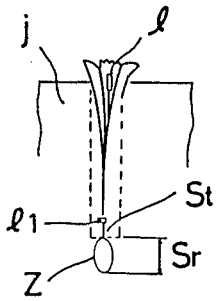

(6) SIXTH STEP (refer to FIG. 12, FIG. 13)

The workpiece-press-plate 31 at the casset 30 is turned down. The ends of the springs 35*a*, 35*b* are hooked to the semicircular shaped notches provided at the lever-fixed-plate 36*a*, 36*b*, and thus the front cloth is pressed. The forward switch 41 is further pressed. The situation returns to the situation of FIG. 6 (except the workpiece-press-plate 31 is pressing the front cloth j). The front cloth and the lining cloth are positioned in correct position. Keeping the correct position of both front cloth and the lining cloth, the casset set 30 is pulled out along the channel 21*a* of the casset table 21 in direction of arrow "H" (FIG. 13). The casset is set on the proper location in the sewing machine and sewing work starts. Stitching will be effectively performed and the zipper will be sewed in the correct position.

According to this embodiment, the required movement of set-plates 15*a*, 15*b* is performed via a four-lever linkage system, and air cylinders are used as the drive source, but it will be understood the invention is not limited to such a linkage system and drive source, and many modifications are contemplated.

Figure 17:
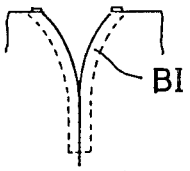
FIG. 17 shows a skirt wherein this invention is applied.

For example, referring to FIG. 1, if some small needles were provided at the surface of the workpiece-press-plate 31 to protect the workpiece from slipping, the position of the workpiece will be more correctly secured. In this embodiment, the movement of the set-plates 15*a*, 15*b* is symmetrical, but more complicated movement may be performed if more solenoid valves for controlling air pressure are installed so that the complicatedly-shaped workpiece may be set in correct position. Additionally, this invention is applicable to a bias-cutting BI of the front cloth as FIG. 17 shows.

Figure 18:
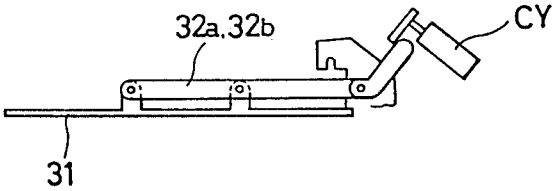
FIG. 18 shows another embodiment of a casset-set with some modifications therein.

Referring to FIG. 18, in this case, the material-press-levers 32*a*, 32*b* are shaped in an "L" and the springs 35*a*, 35*b* are pulling the workpiece-press-plate 31 to clamp the workpiece. Thus, by actuating the end of the material-press-levers 32*a*, 32*b* with an air cylinder CY which is operated by the pedal switch, the manual work is avoided. In the above-described embodiment, the sewing of a zipper to the skirt is described, but this invention is not limited to skirts but is applicable to pajamas or any other fabrics where the similar type of zippers are sewed.

As many apparently widely different embodiments of the invention may be made without departing the spirit and scope therein, it is to be understood that invention is not limited to the specific embodiment thereof except as defined in the appended claims.

What is claimed:

1. An apparatus for setting a workpiece on a sewing machine, comprising:

a casset table which is fixed to a table and sets a casset-set having upper and lower plates to clamp a workpiece, an install-plate which is hinged to move up and down at said table by a horizontal shaft, a pair of set-levers sustained horizontally and in parallel on said install-plate, narrowing means for narrowing the ends of said set-levers to form a "V" shape, moving means for moving said set-levers to reduce the angle of said "V" shape, and driving means to activate said install-plate and said narrowing and moving means.

* * * * *